United States Patent [19]

Olsen et al.

[11] Patent Number: 4,926,658

[45] Date of Patent: May 22, 1990

[54] TWO WAY FLOW CONTROL DEVICE

[75] Inventors: Mark W. Olsen, Carrollton; John B. Winegardner, Hurst, both of Tex.

[73] Assignee: Lennox Industries, Inc., Carrollton, Tex.

[21] Appl. No.: 339,206

[22] Filed: Apr. 14, 1989

[51] Int. Cl.[5] ..... F25B 27/00

[52] U.S. Cl. ..... 62/324.1; 62/324.6; 137/513.3

[58] Field of Search ..... 62/324.1, 324.6; 137/513.3, 512.4

[56] References Cited

U.S. PATENT DOCUMENTS

| | | | |
|---|---|---|---|
| 2,694,296 | 11/1954 | Prosek et al. | 62/324.6 X |
| 3,184,211 | 5/1965 | Chapman et al. | 137/513.3 X |
| 3,274,793 | 9/1966 | Anderson et al. | 62/324.6 X |
| 3,404,542 | 10/1968 | Fineblum | 62/324.6 |
| 3,572,377 | 3/1971 | Graham et al. | 137/513.3 X |
| 3,992,898 | 11/1976 | Duell et al. | 137/513.3 X |
| 4,341,090 | 7/1982 | Ramakrishnan | 62/324.6 X |

*Primary Examiner*—Lloyd L. King

*Attorney, Agent, or Firm*—Allegretti & Witcoff, Ltd.

[57] ABSTRACT

A two way refrigerant control flow device for a heat pump system comprising a cylindrical body open at each end. Provided within the body are a plurality of first axial passages and a second axial passage disposed centrally in said body. The first axial passages are spaced radially outwardly from the second axial passage. Fixedly positioned in the second axial passage is an orifice of predetermined size. A thin annular washer-like valve member is disposed in the valve body and movable between a first position sealing the first axial passages to fluid flow while permitting flow through the second axial passage in one direction of fluid flow, and a second position away from the first axial passage to permit fluid flow through the first axial passage to bypass the second axial passage with flow in an opposite direction. In a preferred embodiment of the invention the orifice in the second axial passage is on the order of .040 inch to .120 inch. Additionally, there are a pair of orifices in the second axial passage spaced apart by a chamber of enlarged cross section and length as compared to the orifices to provide for pressure recovery of the refrigerant throttled in one orifice before it passes through the other orifice.

7 Claims, 1 Drawing Sheet

TWO WAY FLOW CONTROL DEVICE

BACKGROUND OF THE INVENTION

This invention relates to a two way flow control device and, more particularly, to a two way flow control device for use in a heat pump refrigerant circuit.

Normally in a conventional refrigerant circuit an expansion means is provided between the condenser and evaporator in order to meter the flow of refrigerant from the condenser to the evaporator so as to provide a pressure drop for refrigeration effect. The expansion means is ordinarily a capillary tube which relies upon a fixed geometry to achieve refrigerant throttling or an expansion valve has been used in place of the capillary tube.

To convert an ordinary refrigerant system to a heat pump, it is necessary to thermodynamically reverse the flow of refrigerant. The direction of refrigerant flow through the circuit is reversed by changing the connection between the suction and discharge side of the compressor with a four way valve or a reversing valve. The cooling condensor now functions as an evaporator while the cooling evaporator serves as a heating condenser. Reversible refrigerant cycles or heat pump circuits have heretofore generally utilized either parallel capillary tubes with check valves or a double expansion valve and bypass system positioned in the fluid line connecting the two heat exchangers to accomplish throttling in either direction. The Duell et al. U.S. Pat. No. 3,992,898, for example, shows a heat pump system which incorporates a pair of metering devices mounted in opposed relationship in a supply line carrying refrigerant between the two heat exchangers in a heat pump system. Each metering device includes a free-floating piston having an orifice therein slidably mounted in the body of the metering device. There is sometimes instability of operation because the orifice is in the movable piston, which does not always seal with its seat and therefore there may be leakage around the orifice in the movable piston. Turbulence of the refrigerant may cause the movable piston to undesirably back off its valve seat during operation.

An object of the present invention is to provide an improved two way flow control device for metering the refrigerant properly during both the heating cycle and the cooling cycle of a heat pump.

Another object of the present invention is to provide a relatively inexpensive two way flow control device specially suited for use in a heat pump refrigerant circuit, that will accurately throttle the flow of refrigerant in the cooling mode of operation of the heat pump.

Yet another object of the present invention is to provide a two way flow control device for a heat pump refrigerant circuit that has fixed orifice means therein and a thin wafer type valve member for sealing effectively the bypass of refrigerant around the orifice means, which provide for stability in operation.

Other objects and advantages of the present invention will be made more apparent hereinafter.

BRIEF DESCRIPTION OF THE DRAWINGS

There is shown in the attached drawing a presently preferred embodiment of the present invention, wherein like numerals refer to like elements in the various views and wherein.

DETAILED DESCRIPTION OF THE INVENTION

Figure 1:
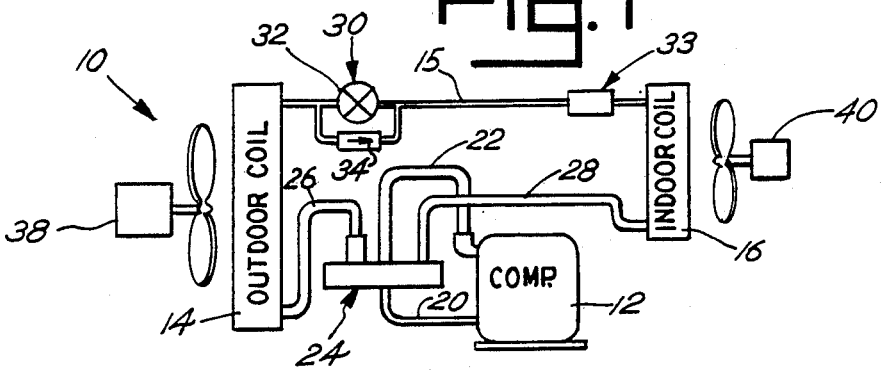
FIG. 1 is a schematic view of a heat pump refrigerant circuit including a two way flow control device embodying the present invention.

Referring to FIG. 1, there is shown a heat pump or reversible refrigeration system 10 embodying a compressor 12, an outdoor coil 14, an indoor coil 16, and connecting conduit means. The discharge line 20 and the suction line 22 from the compressor 12 are connected to a reversing valve or four way valve 24 which will selectively communicate the compressor 12 to the outdoor coil 14 via line 26 and to the indoor coil via a line 28.

Metering means are suitably positioned in the conduit means 15 connecting the outdoor coil 14 and the indoor coil 16. The metering means illustrated comprise a first means 30 and a second means 32 for suitably throttling the flow of refrigerant between the outdoor coil and the indoor coil. The metering means 30 comprises an expansion valve 32 associated with a check valve 34. The second metering means 32 comprises the two way flow control valve of the present invention. The first and second metering means are disposed in the conduit 15 which connects the indoor and outdoor coils 14 and 16 to one another. It will be understood that the metering means 32 may be substituted for the expansion valve 32 and check valve 34, which comprise the first metering means 30.

Fan 38 is associated with coil 14 for passing air thereover and fan 40 is associated with the indoor coil 16 for passing air thereover.

Briefly, in the cooling mode of operation the reversing valve 24, or four way valve as it is sometimes called, is actuated in response to a demand for cooling from a suitable thermostat control so as to place the discharge line 20 from compressor 12 in communication with the outdoor coil 14. The outdoor coil will function as a condensor and the indoor coil 16 will function as an evaporator. Refrigerant will bypass the expansion valve 32 and flow through the one way check valve 34. From the check valve 34, condensed refrigerant will pass through line 15 and the two way flow control valve 33, where it will be throttled or metered. Then the refrigerant will pass to the indoor coil 16, where the refrigerant will be evaporated. Air passing over the indoor coil 16 by fan 40 will be cooled, thereby cooling the area to be cooled.

In the heating mode of operation, the four way valve 24 will be actuated so as to communicate the discharge line 20 with the line 28. Refrigerant will flow through line 28 to the indoor coil 16, then through the two way flow control means 33 line 15 and the expansion valve 32, where the refrigerant is throttled and then back through the outdoor coil 14 in line 26 to the compressor 12. Air passing over the indoor coil 16 will be heated, thereby heating the area to be heated.

Figure 2:
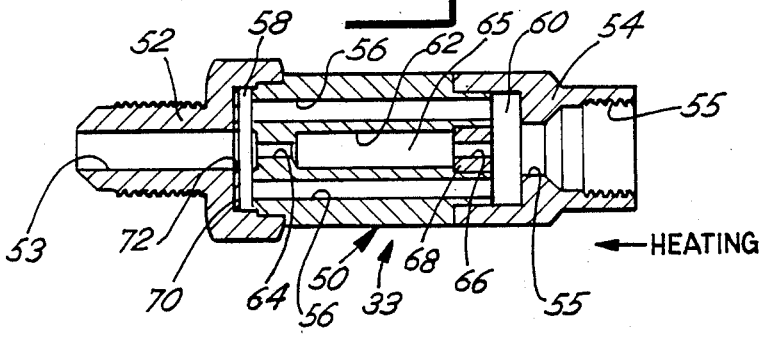
FIG. 2 is a longitudinal cross-sectional view of the two way flow control device of the present invention, illustrating the flow of fluid in the heating mode of heat pump operation wherein the valve member is in position permitting flow to bypass the throttling orifices.
Figure 3:
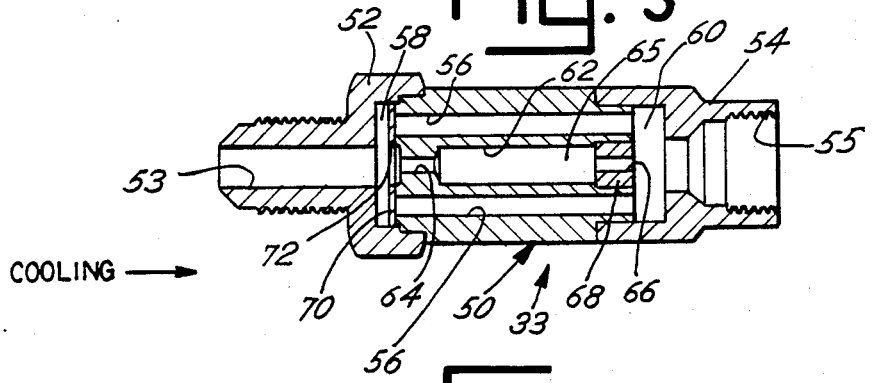
FIG. 3 is a cross-sectional view similar to FIG. 2, but illustrating the flow of fluid in the cooling mode of heat pump operation, wherein the valve member is closing the bypass passages and fluid flow is throttled through the orifices.
Figure 4:
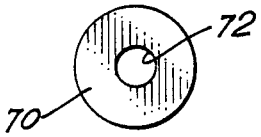
FIG. 4 is a plan view of the annular washer-like valve member in the two way flow control device.

Referring to FIG. 2–4, the two way flow control device 33, includes a main body means 50 having a externally threaded coupling 52 secured at one end and an internally threaded coupling 54 secured at the other end. The couplings 52 and 54 are adapted to be connected into the line 15 connecting the heat exchangers 14 and 16. Other forms of coupling the main body means 50 to line 15 may be used, as will be apparent to persons of skill in the art.

The main body means 50 is comprised of a central cylindrical member preferably made from metal, such as brass, having a plurality of first axial passages 56 therein. The first axial passages 56 are longitudinally extending and preferably comprise drilled bores in the main body 50. These passages 56 are on the order of 9/64 inch diameter and there are four in number in a presently preferred embodiment of the invention. The passages 56 are preferably equally spaced from one another. The first axially extending passages 56 have one end opening into the chamber 58 and the other end opening into the chamber 60 defined within the main body means 50. The second axial passage 62 is centrally oriented and has a pair of orifices therein. An orifice 64 is formed in the passage 62 at one end thereof. Also disposed within the passage 62 in a force fit relationship is a nipple 68 having an orifice 66 therein. Between the orifices 64 and 66 is an enlarged expansion area 65 for permitting some pressure recovery for refrigerant flowing from orifice 64 to orifice 66 during the cooling mode of operation.

There is a valve member 70 in chamber 58 for controlling the flow of refrigerant through the two way flow control device 50. The valve member 70 is responsive to the differential pressure on the opposite sides thereof. Preferably, the valve member 70 is a thin metal or plastic annular washer-like member that will provide a good seal based upon the differential pressure acting upon the valve member. When the valve member 70 is in the position shown in FIG. 2, refrigerant will flow through the passages 56, thereby bypassing the orifices 64 and 66. The valve member 70 is thin and is dimensioned so as to be freely movable within chamber 58 and not hang up or bind against the walls of chamber 58 in use. The chamber 58 is of minimal axial length to confine the valve member 70 for proper action to seal the axial passages 56 in the cooling mode and to open the axial passages 56 to permit bypass of refrigerant about the orifice 66 in passage 62 in the heating mode.

During the heating mode of operation of the heat pump, refrigerant fluid will flow from right to left as seen in FIG. 2. The valve member 70 will be moved to the left as shown in FIG. 2. Fluid will flow through the first passage means 56, and through the opening 72 in the valve member 70. Fluid will then pass from the opening 53 in the coupling member 52 into the line 15 communicating with the outdoor heat exchanger of the heat pump circuit. Refrigerant will bypass the orifices 66 and 64. Expansion valve 32 will control the throttling of refrigerant in the heating mode of operation.

In the cooling mode of operation of the heat pump, refrigerant will flow from left to right as viewed in FIG. 3. The valve member 70 will be moved against the end of the central portion of the main valve body 50, closing the first axial passage 56. All of the refrigerant fluid will be forced to pass through the opening 72 in the valve member 70, through the orifice 64, the enlarged chamber 65, and the orifice 66 and through the opening 55 in the coupling member 54 into the line 15 that communicates the two way flow control device 33 to the indoor heat exchanger 16 in the heat pump circuit.

In the present invention, the orifice 66 is preferably in the range of 0.040 inch to 0.120 inch indiameter for applications on the order of 1 to 5 tons of capacity. The orifice 66 is fixed and stable in operation. By virtue of the enlarged chamber 65 between orifices 64 and 66, pressure recovery is permitted and there is enchanced operation. As best seen in FIGS. 2 and 3, the orifices 64 and 66 are of a predetermined cross section and are spaced apart by a chamber 65 of enlarged cross section and length as compared to the orifices. The chamber 65 provides for pressure recovery of the refrigerant throttled in orifice 66 as it passes to orifice 64 in the cooling mode of heat pump operation.

there has been provided by the present invention a two way flow control device for a heat pump that is compact and will accurately and reliably meter the refrigerant flow to accomodate the different capacities required for the heating and the cooling modes of operation of a heat pump.

While we have shown a presently preferred embodiment of the invention, it will be understood by those persons skilled in the art that the invention may be otherwise embodied within the scope of the appended claims.

We claim:

1. A two way flow control device for use in a heat pump comprising a generally cylindrical body means open at each end, a plurality of first axial passages in said body means, a second axial passage in said body, an orifice of predetermined size fixed in position in said second axial passage, an annular washer-like valve member disposed in said body means and movable between a first position blocking said first axial passages to fluid flow while permitting flow through said second axial passage in one direction of fluid flow, and a second position away from said first axial passage to permit fluid flow through said first axial passages to bypass said second axial passage.

2. A two way flow control device as in claim 1 including an orifice on the order of 0.040 inch to 0.120 inch diameter in said second axial passage.

3. A two way flow control device as in claim 2 wherein there is an opening in said valve member having a cross-sectional area greater than the cross-sectional area of said orifice.

4. A two way flow control device as in claim 1 wherein the valve member is comprised of thin material in washer-like form to give a good seal based upon the differential pressure acting upon the valve member.

5. A two way flow control device as in claim 1 wherein there are a pair of orifices in said second axial passage, said orifices being spaced apart by a chamber enlarged cross section and length as compared to the orifices.

6. In a heat pump comprising a compressor, a reversing valve, an outdoor coil, metering means, and an indoor coil operatively connected to one another, the improvement wherein the metering means includes a two way flow control device comprising a generally cylindrical body means open at each end, a plurality of first axial passages in said body means, a second axial passage in said body, an orifice of predetermined size fixed in position in said second axial passage, an annular washer-like valve member disposed in said body means and movable between a first position blocking said first axial passages to fluid flow while permitting flow through said second axial passage in one direction of fluid flow, and a second position away from said first axial passage to permit fluid flow through said first axial passages to bypass said second axial passage, and orifice means of predetermined diameter fixed in said second axial passage.

7. A heat pump as in claim 6 wherein the orifice means comprises a pair of orifices, each fixed in said second axial passage, said orifices being spaced apart by a chamber of enlarged cross section and length as compared to the orifices.

* * * * *